US006855246B2

(12) United States Patent
Chapus et al.

(10) Patent No.: US 6,855,246 B2
(45) Date of Patent: Feb. 15, 2005

(54) PROCESS AND APPARATUS EMPLOYING A PLURALITY OF CATALYTIC BEDS IN SERIES FOR THE PRODUCTION OF LOW SULPHUR GAS OIL

(75) Inventors: Thierry Chapus, Francheville (FR); Frédéric Morel, Francheville (FR)

(73) Assignee: Institut Francais du Petrole, Rueil-Malmaison Cedex (FR)

( * ) Notice: Subject to any disclaimer, the term of this patent is extended or adjusted under 35 U.S.C. 154(b) by 0 days.

(21) Appl. No.: 09/780,418

(22) Filed: Feb. 12, 2001

(65) Prior Publication Data

US 2002/0139715 A1 Oct. 3, 2002

(51) Int. Cl.[7] ..... C10G 65/04; C10G 45/04
(52) U.S. Cl. ..... 208/210; 208/216 R; 208/217
(58) Field of Search ..... 208/210, 216 R, 208/217

(56) References Cited

U.S. PATENT DOCUMENTS

| | | | | | |
|---|---|---|---|---|---|
| 3,369,998 | A | * | 2/1968 | Bercik et al. | 208/143 |
| 3,519,557 | A | * | 7/1970 | Pruiss | 208/143 |
| 3,594,307 | A | * | 7/1971 | Kirk | 208/143 |
| 3,620,968 | A | * | 11/1971 | Bridge et al. | 208/146 |
| 3,876,531 | A | | 4/1975 | Brunn | 208/210 |
| 3,926,784 | A | | 12/1975 | Christman et al. | 208/210 |
| 4,048,060 | A | * | 9/1977 | Riley | 208/210 |
| 4,392,945 | A | * | 7/1983 | Howard et al. | 208/210 |
| 5,292,428 | A | | 3/1994 | Harrison et al. | 208/208 R |
| 5,316,658 | A | * | 5/1994 | Ushio et al. | 208/15 |

FOREIGN PATENT DOCUMENTS

| | | |
|---|---|---|
| FR | 2 757 532 | 6/1998 |
| WO | WO 96/17903 | 6/1996 |

* cited by examiner

*Primary Examiner*—Walter D. Griffin
(74) *Attorney, Agent, or Firm*—Millen White Zelano & Branigan, P.C.

(57) ABSTRACT

A process for hydrotreating gas oil comprises: a first gas oil desulfurization step carried out in a first catalytic zone comprising a desulfurization catalyst; at least partial elimination of the hydrogen sulphide formed at the end of the first gas oil desulfurization step; one or more additional desulfurization steps carried out in one or more catalytic zones comprising a desulfurization catalyst. The distribution of the catalyst in the different zones can be selected so as to maximise the catalytic activity, and thus minimize the volume of catalyst required for a unit of a given capacity operating at fixed operating temperature and pressure, so as to obtain an intensely desulfurized gas oil.

23 Claims, No Drawings

PROCESS AND APPARATUS EMPLOYING A PLURALITY OF CATALYTIC BEDS IN SERIES FOR THE PRODUCTION OF LOW SULPHUR GAS OIL

FIELD OF THE INVENTION

The present invention relates to fuels for internal combustion engines. More particularly, it relates to the production of a fuel for a compression ignition engine. In this field, the invention relates to a process for transforming a gas oil cut to produce an intensely desulphurised fuel with a high cetane number. Current legislation in the majority of industrialised countries requires that a fuel for use in engines must contain less than about 500 parts per million by weight of sulphur (ppm). Some countries do not currently impose maximum limits on the amounts of aromatic compounds and nitrogen. However, in a number of countries or states, such as Sweden and California, and in particular Sweden, certain classes of diesel fuels already have to satisfy very strict regulations. In that country, class II diesel cannot contain more than 50 ppm of sulphur and class I gas oil cannot contain more than 10 ppm of sulphur. Currently in Sweden, class III diesel fuel must contain less than 500 ppm of sulphur. Similar limits are also imposed for the sale of this type of fuel in California. New environmental standards for 2005 concerning the storage zone of the refinery for that type of fuel (the gas oil pool) require the sulphur content of gas oils to be reduced to 50 ppm or even 30 ppm. Other regulations may also concern the aromatic compound content, the cetane number, the density or the end point.

RELATED ART

The term "gas oil" as used in the present description means both straight run (SR) cuts from a crude petroleum and cuts of this type from different conversion processes, in particular those from catalytic cracking.

Hydrodesulphurisation constitutes the essential refining process for bringing the sulphur contents of those products to the required level.

Conventional gas oil hydrodesulphurisation processes, known as one-step processes as they use a single catalytic bed, have already been proposed. A summary description of such a process can, for example, be found in "Hydrocarbon Processing", September 1984, page 70 or in "Ullmann's Encyclopaedia of Industrial Chemistry", vol. A18, page 65–66. Hydrocarbons are transformed in the reaction zone in the presence of a certain partial pressure of $H_2S$, essentially due to desulphurisation reactions. The presence of $H_2S$ on the hydrotreatment catalyst has the effect of slowing down hydrodesulphurisation reactions very significantly. These processes were sufficient when the desired sulphur contents in the final product were not too low (up to 300–500 ppm). For more intense desulphurisation levels, the inhibiting effect of $H_2S$ becomes critical.

For that reason, two-step processes using two catalytic beds were proposed. An apparatus for stripping the effluent at the outlet from the first bed eliminates the major portion of the $H_2S$, and the second catalyst bed functions with a low partial pressure of $H_2S$ and has a better desulphurising activity.

U.S. Pat. No. 5,292,428 proposes a process for hydrotreating hydrocarbon feeds including gas oils, comprising two or more catalytic zones, with elimination of $H_2S$ at the outlet from the first zone and addition of fresh hydrogen to the second reactor. The $H_2S$ formed is generally eliminated using an amine washing apparatus. The activity of the catalyst in the second catalytic zone is improved because of the low $H_2S$ partial pressure. However, in order to achieve high degrees of desulphurisation, sufficient to satisfy the most intense specifications for sulphur (50 ppm or even 30 ppm), severe operating conditions must be employed from the beginning of the cycle by increasing the operating temperature and pressure and/or using a sufficiently low HSV (volume of feed per volume of catalyst per hour). Increasing the temperature at the start of the cycle may be a problem as regards the cycle time. The operating pressure can only be increased within reasonable limits, for economic reasons. Finally, for a unit with a given capacity, operating with a lower HSV means using a larger volume of catalyst, involving higher operating costs. Further, French patent application FR-A-2 757 532, for example, has described a two-step process using a catalyst containing a group VIII noble metal in the second step, allowing very intense desulphurisation of gas oil cuts. However, that process suffers from a distinct disadvantage due to the use of a noble metal in the second step linked to the cost of such a catalyst and to its sensitivity to hydrogen sulphide, the content of which must be limited to a maximum at the outlet from the first step if a reasonable service life for the catalyst for the second step is desired.

SUMMARY OF THE INVENTION

A process for producing kerosene and/or gas oil with a very low sulphur content has surprisingly been discovered, which process can improve the efficiency of the catalyst function by acting firstly on the partial pressure of $H_2S$, and by optimising the distribution of the residence times (and thus the catalyst volumes) in the different catalytic zones. This process can allow intense desulphurisation with a lower hydrogen consumption than in prior art processes, which is a further very important advantage for the refiner who is constantly searching for low hydrogen consumption processes, as hydrogen is a precious commodity in to the refinery.

More precisely, the hydrocarbon cut is typically a kerosene and/or gas oil with an initial boiling point in the range about 150° C. to 250° C., and with a final boiling point in the range about 300° C. to 400° C. The process of the invention uses two hydrodesulphurisation zones each containing at least one hydrodesulphurisation catalyst containing, on a support, at least one non noble group VIII metal associated with at least one group VIB metal.

Thus in its broadest aspect, the present invention provides a process for hydrodesulphurising a kerosene and/or gas oil cut comprising:

a) at least one first intense hydrodesulphurisation step a) in which said gas oil cut and hydrogen are passed over a catalyst disposed in a fixed bed comprising, on a mineral support, at least one metal or compound of a metal from group VIB of the periodic table in a quantity, expressed as the weight of the metal with respect to the weight of the finished catalyst, of about 0.5% to 40%, at least one non noble metal or compound of a non noble metal from group VIII of said periodic table, in a quantity, expressed as the weight of the metal with respect to the weight of the finished catalyst, of about 0.1% to 30%, and b) at least one subsequent second step b) in which a gas fraction containing at least a portion of the hydrogen sulphide ($H_2S$) contained in the total effluent from said first step and an effluent that is depleted in hydrogen sulphide are recovered;

c) at least one third step c) in which at least a portion of the hydrogen sulphide-depleted effluent from step b) and hydrogen are passed over a catalyst disposed in a fixed bed, identical to or different from that used in step a), comprising, on a mineral support, at least one metal or compound of a metal from group VIB of the periodic table in a quantity, expressed as the weight of the metal with respect to the weight of the finished catalyst, of about 0 5% to 40%, at least one non noble metal or compound of a non noble metal from group VIII of said periodic table, in a quantity, expressed as the weight of the metal with respect to the weight of the finished catalyst, of about 0.1% to 30%, said process being characterized in that the quantity of catalyst used in the first step is about 5% to about 50% by weight of the total quantity of catalyst used in said process.

The first intense hydrodesulphurisation step, step a), is normally carried out in a reaction zone comprising at least one fixed bed of catalyst. This zone can contain a plurality of catalyst beds that may be identical or different. Similarly, step c) is normally carried out in a reaction zone comprising at least one fixed bed of catalyst. This zone can contain a plurality of catalyst beds that may be identical or different. The different catalytic zones may be arranged in different reactors. Several catalytic zones, with the exception of the first zone, can be integrated into one and the same reactor.

The quantity of catalyst used in the first step (step a)) is preferably about 10% to about 40% by weight of the total quantity of catalyst used in said process and more preferably, this quantity is about 15% to about 30% by weight of the total quantity of catalyst used in said process.

In order that the catalyst beds in the reaction zone for step c) can be maintained in the sulphurised state, the concentration of $H_2S$ at the inlet to this second catalytic zone is kept at a sufficient level by adjusting the degree of elimination of the hydrogen sulphide in step b). Step b) for recovering a liquid feed depleted in hydrogen sulphide and a gas fraction containing at least a portion of the hydrogen sulphide contained in the total effluent from step a) can be carried out using any means known to the skilled person. By way of illustration, this recovery of a gas fraction containing at least a portion of the hydrogen sulphide contained in the total effluent from step a) can be effected by stripping using at least one hydrogen-containing gas at a pressure substantially identical to that prevailing in the first step and at a temperature of about 100° C. to about 450° C. under conditions for the formation of a gaseous stripping effluent containing hydrogen and hydrogen sulphide. This recovery can also be carried out, for example, by flashing the total effluent from step a). In a particular implementation of the invention, the gas fraction recovered in step b), containing hydrogen sulphide, is sent to a zone for eliminating at least a portion of the hydrogen sulphide it contains, from which purified hydrogen is recovered that is recycled to the inlet to intense hydrodesulphurisation step a). In this zone, purification of hydrogen from a gas mixture containing hydrogen and hydrogen sulphide from the zone for at least partial elimination of hydrogen sulphide is normally carried out using a technique that is well known to the skilled person, in particular by a prior treatment of this gas mixture by a solution of at least one amine under conditions enabling hydrogen sulphide to be eliminated by absorption, said amine usually being selected from the group formed by monoethanolamine, diethanolamine, diglycolamine, diisopropylamine and methyldiethanolamine. In a particular implementation of this absorption, the gas mixture is brought into contact with a basic solution, preferably an aqueous solution of an amine selected from the group mentioned above, which forms an addition compound with the hydrogen sulphide that can produce a purified gas with hydrogen sulphide contents that are substantially less than 500 ppm by weight and usually less than about 100 ppm by weight. Normally, the residual quantity of hydrogen sulphide is less than about 50 ppm by weight and usually less than about 10 ppm by weight. This method for purifying a gas mixture is a conventional method that is well known to the skilled person and widely described in the literature. As an example, it has been succinctly described for the treatment of a natural gas containing hydrogen sulphide in Ullmann's Encyclopaedia, volume A12, pages 258 ff. Within the context of the present invention, treatment with an aqueous amine solution is normally carried out at a temperature of about 10° C. to about 100° C. and usually about 20° C. to about 70° C. normally, the quantity of amine used is such that the mole ratio of hydrogen sulphide to amine is about 0.1:1 to about 1:1 and normally about 0.3:1 to about 0.8:1, for example about 0.5:1. The pressure at which the hydrogen sulphide is absorbed by the amine is normally about 0.1 MPa to about 50 MPa, usually about 1 MPa to about 25 MPa and more usually about 1 MPa to about 10 MPa. The amine solution is conventionally regenerated by changing the pressure. To obtain a drier gas and for more effective elimination of the hydrogen sulphide initially present in the gas mixture, it is also possible to provide, for at least a portion of this gasoline mixture, a complementary treatment such as treating the gas from the absorption step, in a zone for adsorbing hydrogen sulphide comprising at least one reactor and usually at least two adsorption reactors containing a sieve, for example, preferably a regeneratable sieve or, for example, zinc oxide, operating, for example, at a temperature of about 10° C. to about 400° C. normally about 10° C. to about 100° C. and usually about 20° C. to about 50° C. at a total pressure of about 0.1 MPa to about 50 MPa, normally about 1 MPa to about 25 MPa and preferably about 1 MPa to about 10 MPa. In this implementation, when the adsorption zone comprises two reactors, one reactor is used to treat the gas while the other is being regenerated or the material it contains is being replaced to allow drying and desulphurisation of the gas mixture entering said zone. The hydrogen sulphide content in the gas at the outlet from this complementary treatment is normally less than 1 ppm by weight, usually of the order of a few tens of ppb by weight.

The operating conditions for step a) normally comprise a temperature of about 240° C. to about 420° C., a total pressure of about 2 MPa to about 20 MPa and an hourly space velocity of liquid feed of about 0.1 to about 5, and that of step c) normally comprises a temperature of about 240° C. to about 420° C. and an hourly space velocity of liquid feed at most equal to the hourly space velocity of the liquid feed in step a).

The catalyst(s) used in the different catalytic zone are hydrodesulphurisation catalysts. These catalysts can be conventional catalysts such as those described in the prior art, for example one of the catalysts described by the Applicant in French patent applications FR-A-2 197 966, FR-A-2 583 813 or in European patent document EP-0 297 949. It is also possible to use commercially available catalysts such as those sold by PROCATALYSE. These catalysts each comprise at least one metal or compound of a metal from group VIB and/or at least one non noble metal or compound of a non noble metal from group VIII, on a suitable mineral support.

The catalyst support is generally a porous solid. The support is normally selected from the group formed by alumina, silica, silica-aluminas, zeolites, magnesia, titanium oxide $TiO_2$ and mixtures of at least two of these mineral compounds. Alumina is routinely used.

The group VIB metal is normally selected from the group formed by molybdenum and tungsten, and the group VIII metal is normally selected from the group formed by nickel, cobalt and iron, and usually from the group formed by nickel and cobalt. Combinations such as NiMo or CoMo are typical. In a preferred implementation, the catalyst used in step a) and that used in step c) each comprise molybdenum or a molybdenum compound in a quantity, expressed as the weight of metal with respect to the weight of finished catalyst, of about 2% to 30% and a metal or compound of a metal selected from the group formed by nickel and cobalt in a quantity, expressed as the weight of metal with respect to the weight of finished catalyst, of about 0.5% to 15%. Usually, a catalyst comprising nickel as the group VIII metal and molybdenum as the group VIB metal is used in step a) and in step b).

In a preferred implementation, the catalyst used in step a) and that used in step c) each comprise at least one element selected from the group formed by silicon, phosphorous and boron or one or more compounds of this or these elements.

In a further implementation, the catalysts used in step a) and step c) each comprise at least one halogen. Normally, the quantity of halogen is about 0.1% to about 15% by weight with respect to the weight of finished catalyst. The halogen is normally selected from the group formed by chlorine and fluorine, and in a particular implementation, the catalysts used contain chlorine and fluorine.

The temperature of the different catalytic zones is preferably in the range 260° C. to 400° C., more preferably in the range 280° C. to 390° C. The operating pressures used are preferably in the range 2 MPa to 15 MPa, more preferably in the range 2 MPa to 10 MPa.

The overall hourly space velocity, HSV (volume of feed per volume of catalyst per hour) is in the range 0.1 to 10 $h^{-1}$.

When the process comprises two catalytic zones, the distribution of the residence time in the catalytic zones is such that the residence time in the first catalytic bed represents at most 50% of the overall residence time.

EXAMPLES

Example 1 (Comparative)

A gas oil composed of half straight run gas oil and half LCO (catalytic cracking gas oil) was treated using a one-step process with a single bed of catalyst in a reactor. The characteristics of this gas oil are shown in Table 1.

200 $cm^3$/g of a commercially available catalyst sold by Procatalyse under the reference number HR448 containing nickel and molybdenum in amounts within the ranges indicated in steps a) and c) of the process of the invention were used. After activating the catalyst by sulphurisation, the reactor was kept at a total pressure of 50 bar g (1 bar g is equal to 0.1 MPa) and a temperature of 340° C. The gas oil feed was injected into the bottom of the reactor at an HSV of 1 $h^{-1}$. A quantity of hydrogen corresponding to a $H_2$/feed ratio of 400 1/1 was injected, the feed and hydrogen mixture traversing the catalytic bed in riser mode.

TABLE 1

| Principal characteristics of gas oil feed | |
|---|---|
| 15/4 density (g/$cm^3$) | 0.8984 |
| Sulphur (ppm by wt) | 15900 |
| ASTM D86 distillation | |
| 5% point | 228° C. |
| 50% point | 278° C. |
| 95% point | 359° C. |

Under these conditions, the sulphur content in the gas oil produced stabilised at a value of 60 ppm, i.e., a degree of desulphurisation of 99.62%. The hydrogen consumption with respect to the feed was 1.30% by weight.

Example 2 (Comparative)

The same gas oil was treated using the same catalyst under the same conditions but with injection of the feed into the bottom of the reactor with an HSV of 0.55 $h^{-1}$. Under these conditions, the sulphur content in the gas oil produced stabilised at a value of 10 ppm, i.e., a degree of desulphurisation of 99.94%. The hydrogen consumption with respect to the feed was 1.70% by weight. Thus in addition to the penalties due to the low HSV employed, there was a substantial increase in the hydrogen consumption with respect to the implementation of Example 1, which was a problem from an industrial view point.

Example 3 (Comparative)

The gas oil feed described in Example 1 was treated using a two-step process with a single bed of catalyst in two successive reactors. A stripping apparatus between the two beds eliminated the $H_2S$ produced in the first bed.

This time, two beds of the same HR448 catalyst were used, which were both subjected to the same temperature and pressure conditions (total pressure=50 bar g, T=340° C.). The hydrogen injected into the two catalytic beds was such that the $H_2$/feed ratio in both cases was is 400 1/1.

The first bed was constituted by 150 $cm^3$ of HR448 catalyst and the second bed was constituted by 50 $cm^3$ of HR448 catalyst. The feed flow rate was 200 $cm^3$/h, i.e. an HSV of 1.33 $h^{-1}$ in the first bed and 4 $h^{-1}$ in the second bed. The overall residence time was 1 hour, as in Example 1.

A process scheme with intermediate $H_2S$ stripping between the two catalyst beds can, under the operating conditions defined above, produce a gas oil containing 30 ppm of sulphur, i.e., a desulphurisation degree of 99.81%. The hydrogen consumption was 1.30% by weight with respect to the feed. By operating under these conditions, the hydrogen consumption was substantially identical to that of Example 1 with a slightly improved degree of desulphurisation compared with that obtained using the conditions described in Example 1.

Example 4

Process of the Invention

The gas oil feed used in the preceding examples was treated using the same process as that described in Example 3 and under the same pressure, temperature, feed flow rate and $H_2$/feed ratio. The same overall volume of HR 448 catalyst was used (200 $cm^3$) but with a different distribution between the two beds, which now each contained 100 $cm^3$.

Under these conditions, the overall residence time in the two beds was 1 hour, with a residence time of 0.5 hours for each of the beds (HSV of 2 $h^{-1}$ for each bed).

This particular arrangement of two catalytic beds could produce a sulphur content in the final product of 15 ppm, giving a degree of desulphurisation of 99.91% the hydrogen consumption was 1.30% by weight with respect to the feed. Compared with Example 3, there was a net improvement in the degree of desulphurisation without increasing the hydrogen consumption.

Example 5

Process of the Invention

The conditions in this case were identical to those given for Example 4, with the exception that the volumes of catalyst were respectively 50 $cm^3$ for the first bed and 150 $cm^3$ for the second bed For an overall residence time of 1 hour, the residence time was 0.25 hours in the first bed and 0.75 hours in the second bed.

This particular arrangement of the two catalytic beds produced a gas oil containing 7 ppm of sulphur, i.e. a degree of desulphurisation of 99.96%. The hydrogen consumption by weight with respect to the feed was 1.30%.

Thus, the process of the invention was advantageous for carrying out gas oil desulphurisation treatments. It was particularly advantageous for achieving low sulphur contents in the gas oil of less than 30 ppm (Example 4) or even less than 10 ppm (Example 5). To obtain a given sulphur specification, the process of the invention enables operations to be carried out at higher HSVs and thus economises on catalyst, which is important to the operator. Further, the hydrogen consumption remains constant, again or particular importance to the operator.

What is claimed is:

1. A process for hydrodesulfurising a kerosene and/or gas oil cut to a residual content of less than 30 ppm weight comprising:

at least one first intense hydrodesulfurization step a) in which said kerosene and/or gas oil cut and hydrogen are passed over a catalyst disposed in a fixed bed comprising on a mineral support, at least one metal or compound of a metal from group VIB of the periodic table in a quantity, expressed as the weight of the metal with respect to the weight of the finished catalyst, of about 0.5% to 40%, at least one non noble metal or compound of a non noble metal from group VIII of said periodic table in a quantity, expressed as the weight of the metal with respect to the weight of the finished catalyst, of about 0.1% to 30%, and b) at least one subsequent second step b) in which a gas fraction containing a portion of the resultant hydrogen sulphide contained in the total effluent from said first hydrodesulfurization step a) and an effluent that is partially depleted in hydrogen sulphide are recovered, c) at least one third step c) in which at least a portion of the hydrogen sulphide-partially depleted effluent from step b) and hydrogen are passed over a catalyst disposed in a fixed bed comprising, on a mineral support, at least one metal or compound of a metal from group VIB of the periodic table in a quantity, expressed as the weight of the metal with respect to the weight of the finished catalyst, of about 0.5% to 40%, at least one non noble metal or compound of a non noble metal from group VIII of said periodic table, in a quantity, expressed as the weight of the metal with respect to the weight of the finished catalyst, of about 0.1% to 30%, wherein the quantity of catalyst used in the first step is about 5% to about 40% by weight of the total quantity of catalyst used in said process and wherein the process is conducted under conditions resulting in said kerosene and/or gas oil cut having a sulfur content of less than 30 ppm while minimizing hydrogen consumption.

2. The process according to claim 1, wherein the quantity of catalyst used in the first step is about 10% to about 40% of the total quantity of catalyst used in said process.

3. The process according to claim 1, wherein step b) for recovering a gas fraction at least a portion of the hydrogen sulphide contained in the total effluent from step a) is carried out by stripping using at least one hydrogen-containing gas at a pressure substantially identical to that prevailing in the first step and at a temperature of about 100° C. to about 450° C. under conditions such that a gaseous stripping effluent containing hydrogen and hydrogen sulphide is formed along with a liquid feed that is depleted in hydrogen sulphide.

4. The process according to claim 1, wherein step b) for recovering a gas fraction containing a portion of the hydrogen sulphide contained in the total fraction contained in the total effluent from step a) is carried out by flashing the total effluent from step a).

5. The process according to claim 1, wherein the operating conditions for step a) comprise a temperature of about 240° C. to about 420° C., a total pressure of abut 2 MPa to about 20 MPa and an hourly space velocity of liquid feed of about 0.1 to about 5 and that of step c) comprises a temperature of about 240° C. to about 420° C., a total pressure of about 2 MPa to about 20 MPa and an hourly space velocity of liquid feed of at most equal to approximately the hourly space velocity of liquid feed in step a).

6. The process according to claim 1, wherein the catalyst used in step a) and that used in step c) each comprise at least one metal or compound of a metal from group VIB selected from the group consisting of molybdenum and tungsten and at least one metal or a compound of a metal from group VIII selected from the group consisting of nickel, cobalt and iron.

7. The process according to claim 1, wherein the catalyst used in step a) and that used in step c) each comprise molybdenum or a compound of molybdenum in a quantity, expressed as the weight of metal with respect to the weight of finished catalyst, of about 2% to 30%, and a metal or a compound of a compound of a metal selected from the group consisting of nickel and cobalt in a quantity, expressed as the weight of metal with respect to the weight of the finished catalyst, of about 0.5% to 15%.

8. The process according claim 1, wherein the catalyst used in step a) and that used in step c) each comprise nickel as the group VIII metal, and molybdenum as the group VIB metal.

9. The process according to claim 1, wherein the catalyst used in step a) and that used in step c) each further comprise at least one element selected from the group consisting of silicon, phosphorous and boron or one or more compounds of said elements.

10. The process according to claim 1, wherein the support for the catalysts used in step a) and in step c) are selected independently from the group consisting of alumina, silica, silica-aluminas, zeolites, magnesia, titanium oxide $TiO_2$ and mixtures thereof.

11. The process according to claim 1, wherein the catalysts used in step a) and in step c) each comprise at least one halogen.

12. The process according to claim 1, wherein the catalysts used in step a) and in step c) each comprise a quantity of halogen of about 0.1% to about 15% by weight with respect to the weight of the finished catalyst.

13. The process according to claim 1, wherein the catalysts used in step a) and in step c) each comprise at least one halogen selected from the group consisting of chlorine and fluorine.

14. The process according to claim 1, wherein the catalysts used in step a) and in step c) each comprise chlorine and fluorine.

15. The process according to claim 1, further comprising passing the gas fraction recovered in step b) containing hydrogen sulphide to zone wherein at least a portion of the hydrogen sulphide is eliminated and, from which a zone purified hydrogen is recovered and is recycled to first hydrodesulfurisation step a).

16. The process according to claim 2, wherein the quantity of catalyst used in the first hydrodesulfurization step is about 15% to about 30% by weight of the total quantity of catalyst used in the process.

17. The process according to claim 1, wherein the catalyst support of steps a) or c) is selected from the group consisting of: alumina, silica, silica-alumina, zeolite, magnesia, titanium oxide, and mixtures thereof.

18. The process according to claim 5, wherein said temperature is in the range of about 260° C. to 400° C.

19. The process according to claim 18, wherein said temperature is in the range of about 280° C. to 390° C.

20. The process according to claim 5, where said total pressure is in the range of 2 MPa to 10 MPa.

21. The process according to claim 1, wherein said hydrodesulfurising results in a content of less than 10 ppm weight sulfur.

22. The process according to claim 1,wherein said kerosene and/or gas oil cut has an initial boiling point of about 150° C. to about 250° C. and a final boiling point of about 300° C. to about 400° C.

23. The process according to claim 1, wherein the hydrogen consumption with respect to the feed is 1.3% by weight.

* * * * *

UNITED STATES PATENT AND TRADEMARK OFFICE

CERTIFICATE OF CORRECTION

PATENT NO. : 6,855,246 B2
DATED : February 15, 2005
INVENTOR(S) : Thierry Chapus et al.

It is certified that error appears in the above-identified patent and that said Letters Patent is hereby corrected as shown below:

Title page,
Insert item -- [30] Foreign Application Priority Data: Feb. 11, 2000 (FR) 00/01.811 and Mar. 2, 2000 (FR) 00/02.809 --.

Column 7,
Line 33, "residual content" should read -- residual sulfur content --.
Line 35, the word "intense" should be deleted.

Column 8,
Line 38, "and a" should read -- and at least one of a --.
Line 38, "or a" should read -- or at least one of a --.
Line 39, "compound of a compound of a compound of a" should read -- compound of a --.

Column 9,
Line 8, "to first" should read -- to the first --.

Signed and Sealed this

Thirty-first Day of May, 2005

JON W. DUDAS
*Director of the United States Patent and Trademark Office*